United States Patent [19]

Shirvill

[11] Patent Number: 4,746,286

[45] Date of Patent: May 24, 1988

[54] BURNER FOR A GASEOUS FUEL

[75] Inventor: Leslie C. Shirvill, Ince, England

[73] Assignee: Shell Oil Company, Houston, Tex.

[21] Appl. No.: 78,952

[22] Filed: Jul. 29, 1987

[30] Foreign Application Priority Data

Oct. 14, 1986 [GB] United Kingdom ..... 8624632

[51] Int. Cl.[4] ..... F23D 14/12

[52] U.S. Cl. ..... 431/328

[58] Field of Search ..... 431/328, 329

[56] References Cited

U.S. PATENT DOCUMENTS 3,425,675 2/1969 Twine ..... 263/41

3,822,986 7/1974 Tsekhovoi et al. ..... 431/328

FOREIGN PATENT DOCUMENTS 3102742 1/1982 Fed. Rep. of Germany .

*Primary Examiner*—Carroll B. Dority, Jr.

*Attorney, Agent, or Firm*—Ronald R. Reper

[57] ABSTRACT

Burner (1) for a gaseous fuel comprising a distributing zone (2) surrounded by an outer wall (4) of a porous medium, an air supply tube (9) debouching in the distributing zone (2), a fuel supply tube (12), and a mixing head (13) arranged in the air supply tube (9), which mixing head (13) comprises a box (15) in which the fuel supply tube (12) debouches and open-ended mixing tubes (23 and 24), which extend through the box (15), wherein the part of the wall of a mixing tube (24 or 25) located in the box (15) is provided with openings (29).

9 Claims, 2 Drawing Sheets

BURNER FOR A GASEOUS FUEL

BACKGROUND OF THE INVENTION

The present invention relates to a burner for a gaseous fuel comprising a distributing zone surrounded by an outer wall consisting at least partly of a porous medium. In the distributing zone of a known burner for a gaseous fuel debouches a device for introducing a premixed fuel/oxidant mixture. Such a device is in general so constructed that the fuel/oxidant mixture introduced into the distributing zone is evenly distributed over the inside of the wall of porous medium.

It is an object of the present invention to provide a burner for a gaseous fuel provided with means for efficiently mixing fuel and oxidant in the distributing zone.

SUMMARY OF THE INVENTION

To this end the burner for a gaseous fuel according to the invention comprises a distributing zone surrounded by an outer wall consisting at least partly of a porous medium, an oxidant supply conduit debouching in the distributing zone, a fuel supply conduit, and a mixing head arranged in the oxidant supply conduit, which mixing head arranged in the oxidant supply conduit, which mixing head comprises a box in which the fuel supply conduit debouches and open-ended mixing tubes which extend through the box, wherein the part of the wall of a mixing tube located in the box is provided with openings.

DESCRIPTION OF PREFERRED EMBODIMENTS

Figure 1:
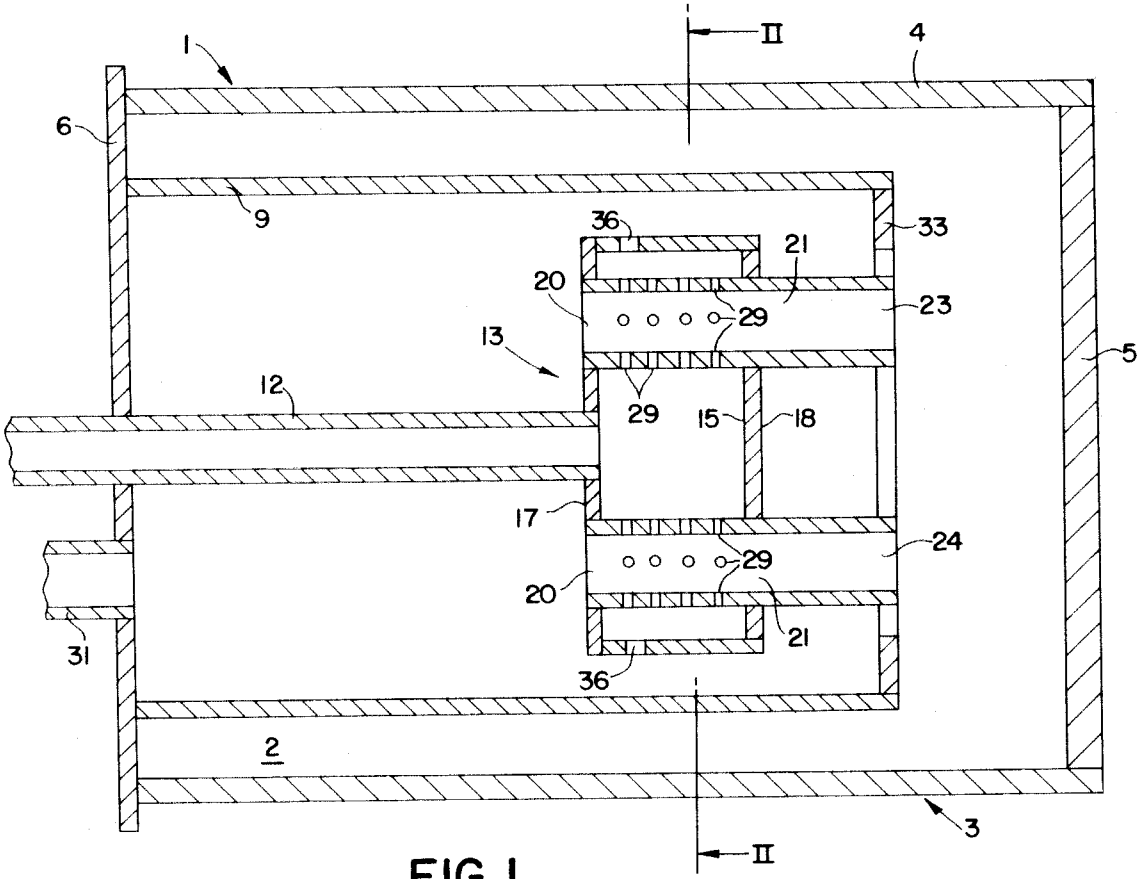
Figure 2:
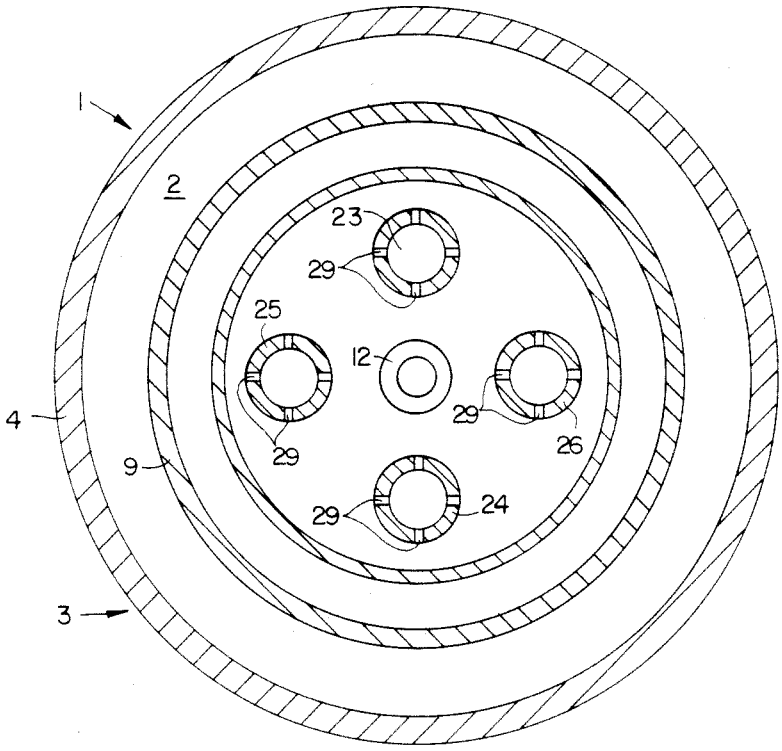

The invention will now be described by way of example in more detail with reference to the drawings, wherein FIG. 1 show schematically a longitudinal section of a burner according to the invention; and FIG. 2 shows a cross-section of FIG. 1 along the line II—II.

Reference is made to FIGS. 1 and 2 showing a burner 1 for a gaseous fuel comprising a distributing zone 2 surrounded by an outer wall 3. The outer wall 3 comprises a circle cylindrical part 4 consisting of a porous medium and an impermeable end wall 5 joined to the cylindrical part 4. The cylindrical part is joined to a base place 6.

The burner 1 further comprises an oxidant supply conduit 9 debouching in the distributing zone 2, a fuel supply conduit 12, and a mixing head 13 arranged in the oxidant supply conduit 9.

The mixing head 13 comprises a box 15 in which the fuel supply conduit 12 debouches. The box 15 comprises an end plate 17 provided with openings 20 and an end plate 18 provided with openings 21 located opposite to openings 20. The mixing head 13 further comprises four open-ended mixing tubes 23, 24, 25 and 26 which extend through the openings 20 and 21. The mixing tubes 23, 24, 25 and 26 extend through the box 15, and the part of the wall of each mixing tube 23, 24, 25 or 26 located in the box 15 is provided with openings 29. For the sake of clarity mixing tubes 25 and 26 are not shown in FIG. 1, and not all openings in the part of the wall of the mixing tubes located in the box have been indicated with reference numerals.

During normal operation, a gaseous fuel is supplied to the mixing head 13 through the fuel supply conduit 12, and oxidant is supplied through conduit 31 to the oxidant supply conduit 9. The gaseous fuel flows into the interior of the box 15, and from there through the openings 29 into the open-ended mixing tubes 23, 24, 25 and 26. A part of the oxidant supplied to the oxidant supply conduit 9 flows through the open-ended mixing tubes 23, 24, 25 and 26 and entrains the gaseous fuel so that a thoroughly mixed fuel/oxidant mixture is produced. The fuel/oxidant mixture flows out of the mixing tubes 23, 24, 25 and 26 into the annular space between the oxidant supply conduit 9 and the circle cylindrical part 4 of the outer wall 3 which part consists of a porous medium. The mixture is ignited by means of an ignition device (not shown) arranged near the outer surface of the cylindrical wall part 4, and the mixture burns in the outer layers of the cylindrical wall part 4.

An advantage of this embodiment is that the fuel/oxidant mixture cools the impermeable end wall 5.

A further advantage of the burner according to the invention is the mixing device is located in a zone which is otherwise wasted. In the burner according to the invention only part of the inner space of the burner is filled with a combustible fuel/oxidant mixture.

To restrict the amount of oxidant bypassing the mixing tubes 23, 24, 25 and 26, the opening of the oxidant supply tube may be provided with a flow restriction in the form of a ring 33.

Furthermore, to allow some fuel to mix with oxidant outside the box 15, the outer wall of the box 15 may be provided with openings 36 through which oxidant can flow into the box to be mixed with fuel in the box 15.

In an alternative embodiment of the invention the impermeable end wall 5 is replaced by a wall of porous medium so that the burner can be used for space heating.

The gaseous fuel for the burner according to the invention may be any gaseous fuel, for example natural gas, synthesis gas or refinery gas. The oxidant is a free oxygen-containing gas such as air.

Suitably the ratio of the diameter of the oxidant supply conduit 9 and the diameter of the distributing zone 2 is between 0.6 and 0.8.

The ratio of the diameter of the mixing head 13 and the diameter of the oxidant supply conduit 9 may be selected between 0.8 and 1 in which case part of the wall of conduit 9 forms the outer wall of the mixing head 13.

The ratio of the length of the oxidant supply conduit 9 and the length of the distributing zone 2 is suitably between 0.7 and 0.9.

The distributing zone 2 may as well have a square cross-section or a rectangular cross-section.

The porous medium may comprise sintered metal fibers, porous ceramic material or other suitable materials.

I claim:

1. A burner for gaseous fuel comprising:

a burner outer wall consisting at least partly of a porous medium and defining an inner distribution zone;

an oxidant supply conduit concentrically mounted within said distribution zone, said conduit debouching in said distribution zone;

a mixing head concentrically mounted within said oxidant supply conduit, which mixing head comprises a closed, walled box having plurality of open-ended, apertured mixing tubes extending through said box for mixing fuel and oxidant, and a fuel supply conduit disposed to supply fuel solely to said mixing head.

2. Burner as in claim 1, wherein said mixing head comprises at least three mixing tubes.

3. Burner as in claim 1, wherein the walls of the mixing head box are provided with openings for mixing fuel and oxidant.

4. Burner as in claim 1, wherein said outer wall comprises an impermeable part and an end part of porous medium.

5. Burner as in claim 1, wherein said distributing zone has a circle cylindrical cross-section.

6. Burner as in claim 5, wherein the cycle cylindrical part of the outer wall comprises a porous medium.

7. Burner as in claim 1, wherein the ratio of the diameter of the oxidant supply conduit and the diameter of the distributing zone is between 0.6 and 0.8.

8. Burner as in claim 1, wherein the ratio of the diameter of the mixing head and the diameter of the oxidant supply conduit is between 0.8 and 1.

9. Burner as in claim 1, wherein the ratio of the length of the oxidant supply conduit and the length of the distributing zone is between 0.7 and 0.9.

* * * * *